US005190372A

United States Patent [19]

Kasberger

[11] Patent Number: 5,190,372

[45] Date of Patent: Mar. 2, 1993

[54] MIXER

[75] Inventor: Peter Kasberger, Aystetten, Fed. Rep. of Germany

[73]. Assignee: Lescha Maschinenfabrik GmbH & Co. KG, Augsburg, Fed. Rep. of Germany

[21] Appl. No.: 653,344

[22] Filed: Feb. 8, 1991

[30] Foreign Application Priority Data

Mar. 1, 1990 [DE] Fed. Rep. of Germany ..... 4006434

[51] Int. Cl.[5] ..... B28C 7/00; B28C 7/16

[52] U.S. Cl. ..... 366/45; 366/47; 366/48; 366/185; 366/220

[58] Field of Search ..... 366/45, 47, 48, 55, 366/62, 63, 43, 46, 44, 53, 54, 60, 220, 232, 185, 187; 475/178, 162

[56] References Cited

U.S. PATENT DOCUMENTS

| | | | |
|---|---|---|---|
| 1,513,337 | 10/1924 | Mélotte | 366/220 |
| 1,767,866 | 6/1930 | Wildhaber | 475/178 |
| 2,170,951 | 8/1939 | Perry | 475/178 |
| 2,179,970 | 11/1939 | Wallace | 366/220 |
| 3,304,808 | 2/1967 | Grant | 475/178 |
| 4,027,541 | 6/1977 | Nishioka | 475/178 |
| 4,884,473 | 12/1989 | Lew | 475/178 |

FOREIGN PATENT DOCUMENTS

| | | | |
|---|---|---|---|
| 0242368 | 1/1987 | Denmark | 366/45 |
| 0284365 | 6/1913 | Fed. Rep. of Germany | 366/232 |
| 0660028 | 2/1929 | France | 475/178 |
| 0415838 | 11/1946 | Italy | 366/60 |
| 1364486 | 1/1988 | U.S.S.R. | 366/54 |
| 0184536 | 8/1922 | United Kingdom | 475/178 |

*Primary Examiner*—Harvey C. Hornsby
*Assistant Examiner*—Tony G. Soohoo
*Attorney, Agent, or Firm*—Harrison & Egbert

[57] ABSTRACT

A mixer having a drum and a motor drivingly connected to the drum. The drum is mounted on a pivotting arm in a cantilever fashion. The pivotting arm has a bushing coaxial with an axis of the drum. The pivotting arm has a cable channel formed therein so as to enable an electrical connection to the motor. The motor has a drive shaft in driving connection with a transmission connected to the drum. The motor has a stator secured to a flange affixed to the bushing. The shaft has an eccentric engaging the step-down transmission so as to cause the drum to rotate relative to a speed of the motor. The electrical connection extends through a hole in the bushing. The electrical connection extends to a switchplug of a pivot axis of the pivotting arm.

2 Claims, 4 Drawing Sheets

1a
2
11
12
10
14
28
13
29
9
8
30
a
32
33
19
15
16
18
17
20
31
12a
34

MIXER

BACKGROUND OF THE INVENTION

The invention relates to a mixer and more particularly a mixer for constructional materials, comprising a drum which at its bottom is mounted on a pivoting arm in a cantilever fashion and adapted to be driven by means of a drive device having at least a motor or engine and a step-down transmission, the bottom of the drum being designed with two walls in order to receive two drum bearings.

In the case of conventional arrangements of this type the drum is surrounded by a ring of gear teeth which are in engagement with a pinion which is centered on the pivot axis of the pivoting arm and is able to be driven by means of shaft from a prime mover positioned on the frame. Arrangements of this type lead to the production of a comparatively large amount of noise.

Therefore mixers without rings of teeth of the type initially mentioned have been developed. In the case of the known arrangements of this type the pivot arms are provided with the drive device on the side opposite to the drum. The drive device therefore projects from the pivot arm in a direction opposite to the drum. It is a disadvantage in this case that owing to the fact that the drive device projects from the pivot arm in the opposite direction to the drum there is a large overall circle of pivoting so that when a wheelbarrow is pushed underneath the drum there is a danger of the moving parts of the mixer crashing down onto it.

SHORT SUMMARY OF THE PRESENT INVENTION

Accordingly one object of the invention is to avoid the disadvantages in the prior art indicated and to provide an improved mixer of the type initially mentioned, which is more particularly simple and compact in its design.

A further object of the invention is to provide a mixer which is comparatively quiet in operation.

Yet another aim of the invention is to devise such a mixer which is highly reliable in use and perform its appropriate functions without fail.

In order to achieve these and/or other aims, in the invention the drive device is at least partly positioned in the part between the bearings of the drum.

This design leads to the useful advantage that at least in part the drive device is positioned in the chamber present between the two walls of the bottom of the drum. In this respect the chamber produced by the two walls of the bottom of the drum functions simultaneously advantageously as an accommodation space in which the drive devices may be placed completely or in part. This in turn leads to the useful advantage of a reduction or complete avoidance of the projection of the drive device past the pivoting arm. There is therefore a comparatively small overall turning circle so that it is readily possible for a wheelbarrow to be pushed underneath without any chance of the drum crashing down on top of it when the drum is rocked. Simultaneously the arrangement leads to the useful further advantage that there is an arrangement of the drive device which is protected against dirt and mechanical impacts and is noise-proofed. It is furthermore covered in such a manner that workers will not be injured by its and will not be splashed with drops of concrete. Since there is no external drum drive, there is more freedom as regards the design of the members mounted on the frame. Therefore it is possible to have a comparatively simple and robust system mounted on the frame.

Advantageous further developments and convenient features of the invention are described in the claims. As one such possible feature at least the step-down transmission may be arranged within the double walled part of the drum bottom. The drive motor may in this case be provided outside the drum, this furthermore making possible the use of an IC engine and in any case making possible simple cooling of the particular form of prime mover utilized.

In accordance with a further possible development of the invention the step-down transmission is in the form of an epicyclic transmission and more particularly of a planocentric drive or the like. Such a transmission has a particularly flat form and this in turn makes possible the design of the mixer with a particularly flat or low cross section, without impairing the mixing efficiency thereof, at the chamber constituted by the double-walled construction.

In many cases it may also be an advantage if the drive motor which is designed in the form of an electric motor, is arranged within the double-walled part of the bottom of the drum. These features lead to particularly high degree of compactness and simultaneously make possible an encapsulation of the entire transmission system.

A further possible feature of the invention is such that the transmission motor is designed in the form of an external rotor electric motor, whose central stator is connected with a king pin (which is secured to the pivoting arm and mounts the drum bearings), such king pin having a cable passage, while the external rotor (which is bearinged on the latter) is flange-mounted on the drive input side of the step-down transmission. These features lead to a particularly high degree of compactness and simultaneously ensure a simple and very sturdy manner of construction, since the king pin may have a comparatively large diameter.

In order to provide protective insulation between the stator and the king pin it is possible to arrange an insulating bushing which is preferably in the form of a torque transmitting element, which is further improved by the provision of terminal insulating collars.

The invention will now be described in more detail with reference to the accompanying drawings, which show several working embodiments thereof in order to make clear further possible features and advantages.

LIST OF THE SEVERAL VIEWS OF THE DRAWINGS

DETAILED ACCOUNT OF WORKING EMBODIMENTS OF THE INVENTION

Figure 1:
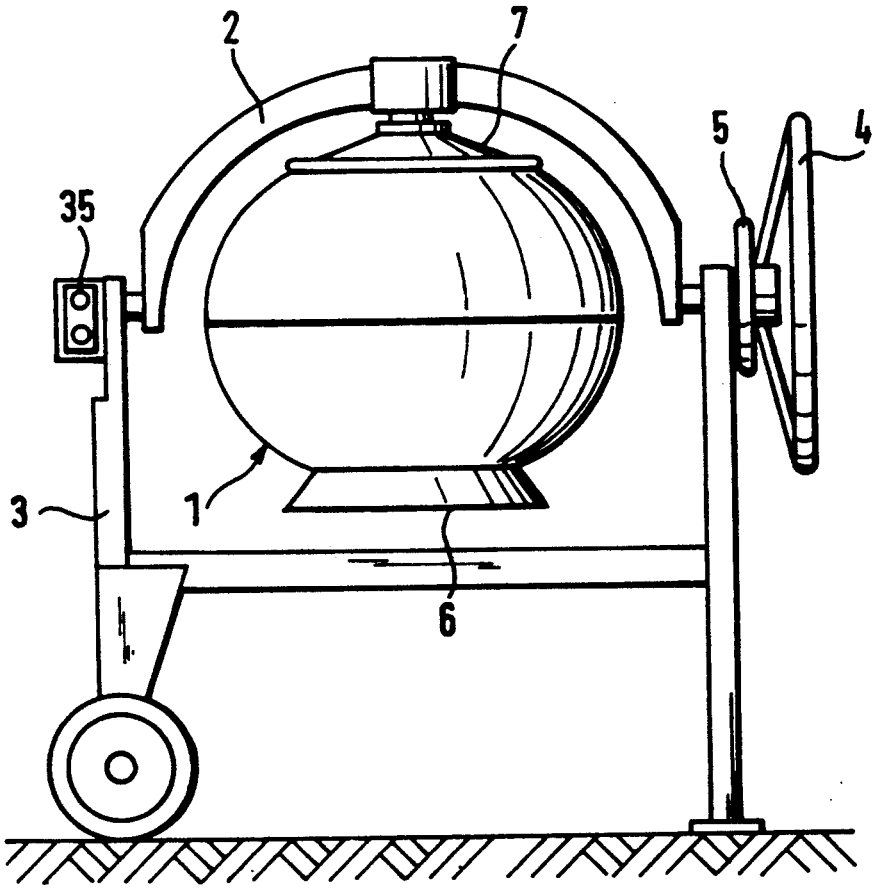
FIG. 1 is an elevation of one possible form of the constructional material mixer in accordance with the invention.

The constructional material mixer illustrated in FIG. 1 consists of a drum 1, which is bearinged on a pivoting arm 2 so as to be centered on the axis of symmetry thereof, such pivoting arm being for its part bearinged at both ends on an H-like machine frame 3. This machine frame is on the one hand provided with a supporting foot and on the other hand with traveling wheels. The pivoting arm 2, which is borne at both ends, in this case constitutes a yoke fitted around the bottom of the drum 1. However it would also be possible, naturally, to provide a pivoting arm with a bearing only at one end and on which the drum 1 would be arranged. The pivoting arm 2 and the drum 1 arranged on it are able to be rocked by means of a rocking device which in this case is in the form of a hand wheel 4 and able to be arrested or locked by means of a detent device, which is here in the form of detent disk 5.

In its filling and mixing position the drum 1 is generally so set that its opening 6 is directed obliquely upwards. In order to discharge from the drum 1 the latter is so rocked that its opening 6 is directed obliquely downwards. In FIG. 1 the drum 1 is on the other hand rocked so that its opening 6 is directed straight downwards, this corresponding to the traveling position.

Figure 2:
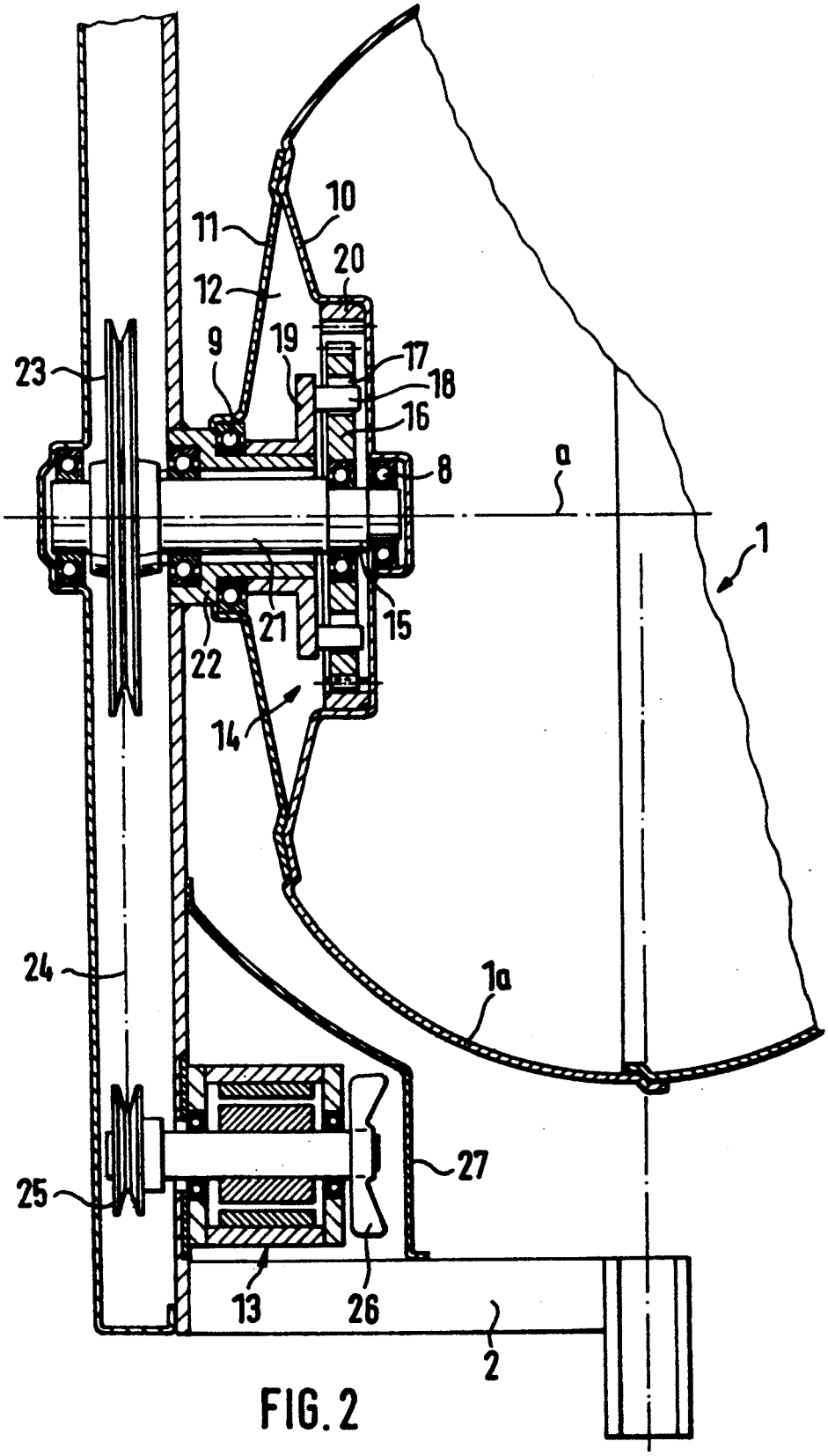
FIG. 2 is a view of part of a further constructional material mixer in accordance with the invention with a drive device which is arranged partly within the drum and part on the pivoting arm.
Figure 3:
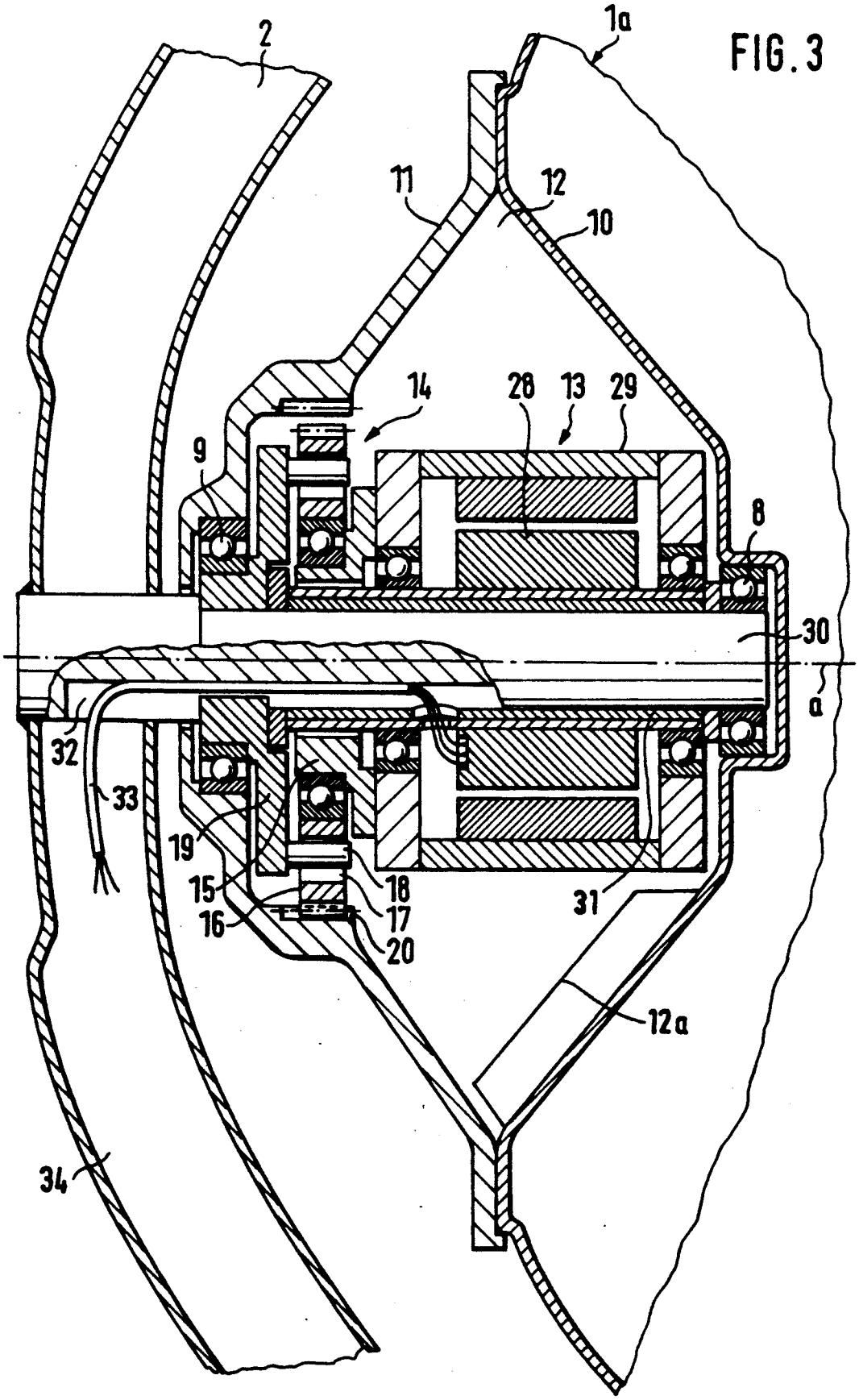
FIG. 3 is partial view of a constructional material mixer in accordance with the invention having a drive device arranged completely within the drum.

At its bottom 7, which is opposite to the opening 6 thereof, the drum is cantilever mounted. For this purpose there are, as shown in FIGS. 2 and 3, two drum bearings 8 and 9 provided adjacent to the drum bottom 7, by means of which it is possible for the drum 1 to be mounted on a shaft carried on the pivot arm 2. In order to receive these two drum bearings 8 and 9, which is are set at a distance from each other, the drum's bottom 7 is made with two walls. For this purpose the lower part of the drum may at its bottom be provided with an inwardly projecting bell 10, on which a peripherally abutting cover 11 is mounted. The latter may be constituted by a casting or a sheet metal pressing. The same applies for the bell 10. In the illustrated working embodiment the bell 10 is simply formed on the lower part 1*a* of the drum, which is for its part in the form of deep drawn member.

The bell 10 and the cover 11 define a chamber 12 between them and in this chamber the drive device, provided for the drum 1, is completely or partly housed. The drive device is constituted by a drive motor 13 and a step-down transmission 14 whose input is connected with the drive motor and whose output is connected with the drum and which functions to reduce the speed of rotation of the motor to the desired speed of rotation. For this purpose a transmission ratio of about 50 to 1 is necessary.

In the case of the arrangement in accordance with FIG. 2 the chamber 12 functions as the space for housing the step-down transmission 14. The drive motor 13 in this case received on the pivot arm 2, this making possible simple cooling of the motor or engine 13 and the step-down transmission 14, something leading to a particularly compact arrangement and simultaneously leading to complete encapsulation of the entire drive device within the chamber 12.

The step-down transmission 14 is in any case designed in the form of a planetary epicyclic or reduced epicyclic transmission unit, which is of flat construction. In the illustrated working embodiments the step-down transmission 14 is designed in the form of a planocentric transmission. In this respect it is a question of a speed reducing epicyclic transmission, which has at least one inner gear 16, which is bearinged on a drive eccentric 15 and accordingly rotates eccentrically and is provided with holes 17 arranged on a circle and into which there fit the pins 18, which are secured to a pin support 19 which is centered on the axis a of rotation of the eccentric 15, and has an outer gear 20 comprising the inner gear 16. The inner gear 16 is externally toothed. The outer gear 20 is internally toothed. The pitch circle diameter of the teeth of the outer gear 20 is larger than the pitch circle diameter of the teeth of the inner gear 16 so that the outer teeth of the inner gear 16 are in engagement with the inner teeth of the outer gear 20 along an engagement range adjacent to the hump of the eccentric 15, of approximately 80°, the outer gear 20 being arranged coaxially to the pin carrier 19 and accordingly centered on the axis a of rotation of the eccentric 15. The number of teeth on the outer gear 20 is larger, preferably by one, than the number of the teeth on the inner gear 16.

When the eccentric 15 is driven the inner gear 16 will be in rolling engagement with the outer gear 20 and owing to the small difference in the number teeth of about three it is possible to achieve the desired high transmission ratio. For this purpose either the pin support 19 or the outer gear 20 is held fast. The respectively other element then turns about the axis a. The restrained element is connected directly or indirectly with the pivot arm 2. The rotating element is connected with the drum 1 to be driven. In the illustrated working embodiments as shown in FIGS. 2 and 3 the pin support 19 is held fast and the outer gear 20 is connected with the drum 11. In the case of a cast cover 11 or, respectively, bell 10 the outer gear 20 may be formed on such a casting, as shown in FIG. 3. In the case of this working embodiment the step-down transmission 14 is positioned on the side of the motor 13 adjacent to the cover 11. The outer gear 20 is accordingly formed on the cover 11, which is in the form of a casting. In the sheet metal construction in accordance with FIG. 2 the outer gear 20 is in the form of an inserted member. In this illustrated working embodiment the bell 10 is provided with a molded depression, into which the outer gear 20, which is fixed to the drum, is inserted. In both cases the pin support 10 is fixed in relation to the pivot arm 2.

In the illustrated working embodiment of FIG. 2 the eccentric 15 of the step-down transmission 14 is driven by a drive shaft 21, which is bearinged on the pivot arm 2. The eccentric 15 may be molded on the drive shaft 21, which for this purpose is simply made in the form of a crank shaft. The drive shaft 21 is at its end adjacent to the drum provided with a pin, that is adjacent to the eccentric and is centered on the axis a, such pin functioning to receive the inner drum bearing 8. The outer drum bearing 9 is in this case received on a bushing 22, which has the drive shaft 21 extending through it and is secured to the pivot arm 2.

In the case of the working embodiment illustrated in FIG. 2 the externally arranged drive motor 13 is arranged on the pivot arm 2 with its axis parallel to and offset from the axis a. The drive motor 13 may in this case be arranged on the side of the pivot arm 2 adjacent to drum 1 so that the same does not project proud of the side remote from the drum 1. In the illustrated working embodiment for this purpose the drive motor 13 is arranged in one corner of the pivot arm which is designed in the form of U-like yoke or angle bracket. The drive shaft 21 is in this case provided with a drive element in the form of a belt pulley 23, which is connected by means of a transmission element, in the present case in the form of a V-belt 24, with the output drive element 25 of the drive motor 13. The use of a belt drive system facilitates the provision of effective insulation for the mixer. For this purpose the drive motor 13 may in addition be insulated by means of insulating sheeting and/or and insulating screw means to electrically separate it from the pivot arm 2.

The drive motor 13, which is arranged outside the chamber 12, may be in the form of an IC engine which owing to its arrangement on the pivot arm 2 should be provided with a pressure lubricating system. In the illustrated working embodiment an electric motor is used. The same may be provided with a fan wheel 26 in order to ensure reliable air cooling. In order to provide effective protection against splashing and rain the externally arranged drive motor 13 is in the present case provided with a protective shroud 27 mounted on the pivot arm 2.

Figure 4:
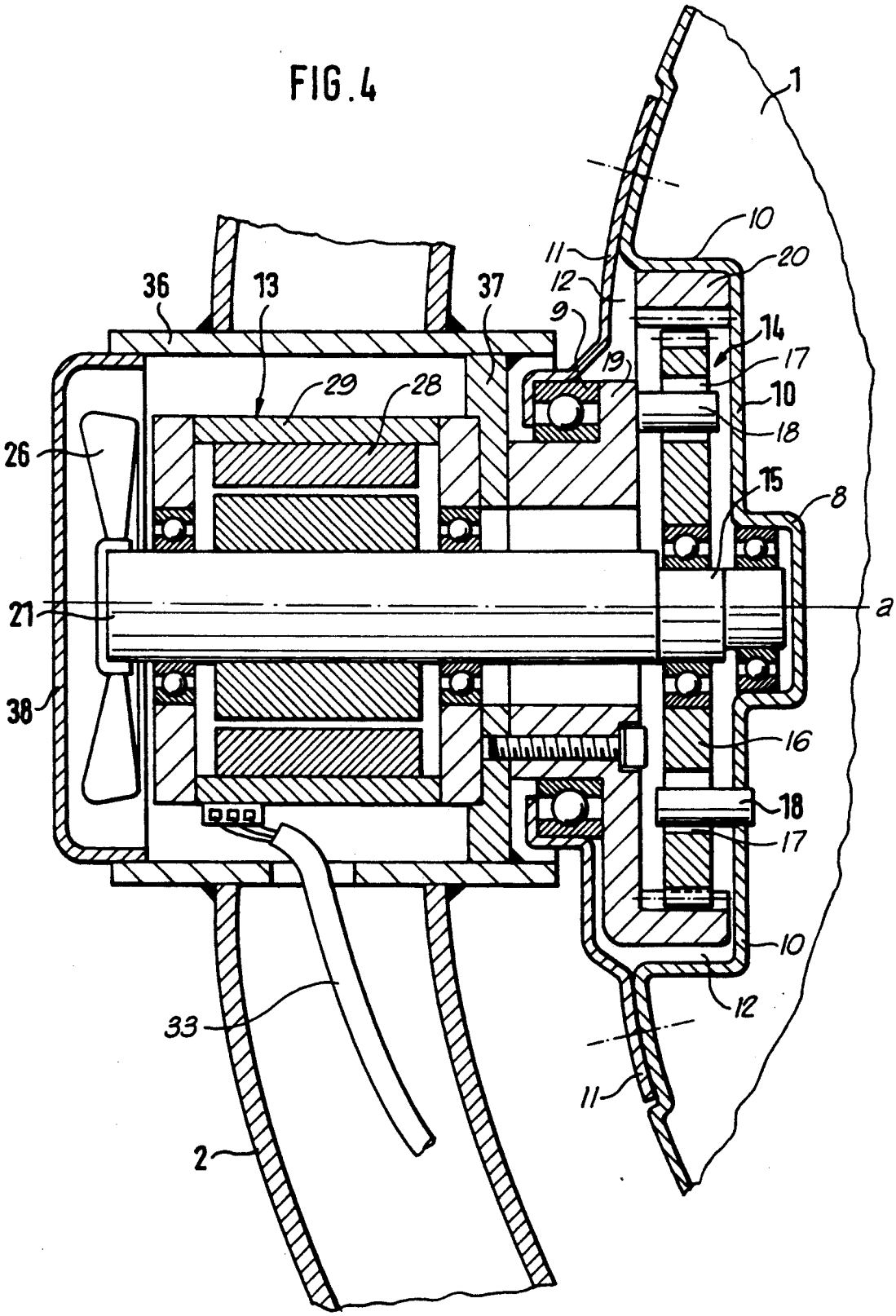
FIG. 4 is a partial view of a further embodiment of the invention with a drive device arranged partly within the drum and partly on the pivoting arm.

Furthermore it is possible not to have a motor 13 offset in relation to the axis a but rather a drive motor arranged with its motor shaft centered on the axis a. Such a motor might also be arranged on the pivot arm 2 and be flange mounted thereon in place of the belt pulley 23. Such an arrangement is illustrated in FIG. 4.

In this case the motor is arranged in a bushing 36 which is generally parallel to the drive shaft 21, of the pivot arm 2. Here it is a question of an electric motor in the form of an internal rotor motor, whose stator is mounted on a flange 37 secured to the bushing 36 and whose rotor may keyed on the drive shaft 21, on which the eccentric 15 is fixed. A fan wheel 26 is mounted on the end, which extends to the rear from the motor, of the motor shaft constituting the drive shaft 21 and this fan wheel is arranged behind a cover 38, which is secured to the outer end of the bushing. This cover may have an air induction duct, not illustrated, with a number of bends therein, and/or a discharge duct which provides full protection against contact and splashed water.

In other respects the present arrangement may be the same as the arrangement in accordance with FIG. 2, which indicates the upper half of the step-down transmission 14. In the lower half of the step-down transmission 14 a possible modification is illustrated in which the pin 18 is stationary, and it is connected with a bell 10 and the outer gear 20 is driven.

In the illustrated working embodiment of FIG. 3 the eccentric 15 of the step-down transmission 14 is directly flange-mounted on the rotor of the drive motor 13, which in this case is arranged within the chamber 12 and is adjacent to the step-down transmission 14. In the case of a drive motor arranged within the chamber 12 it may be a question of a standard internal rotor motor with a driven motor shaft, on which the eccentric 15 may be formed or, respectively, flange-mounted. In the case of the example illustrated in FIG. 3 the drive motor 13 is constituted by an external rotor motor with a central stator 28 and a driven housing 29 surrounding the same. This design leads to particularly satisfactory cooling, since here the air in the space around the motor may be kept on the move and therefore the heat is reliably transmitted to the bell 10 and is conducted away in the same. In order to improve the removal of the heat the latter be may provided with cooling fins 12*a* projecting into the chamber 12.

In order to mount the drum 1 the pivot arm 2 is provided with a king pin 30 attached to it, on which the stator 28 is keyed. In this case in the illustrated working embodiment a splined torque transmission bushing 31 is used which is simultaneously in the form of an insulating bushing or sleeve, by means of which the stator 28, which is live, is electrically separated from the king pin 30. The latter is accordingly also provided with circumferential insulating collars adjacent to its ends. The housing 29 which in the present case functions as the motor rotor, is bearinged on the bushing 31, which may be designed with double walls with the insulating layer on the inside and the support layer to the outside, and the eccentric 15 on the transmission side is flange-mounted on the bushing 31, such eccentric being provided with a hole centered on the axis a through which the king pin 30 and its bushing 31 fit. The inner drum bearing 8 is directly received on the end of the king pin 30, which is adjacent to the drum. The outer drum bearing 9 is seated on a collar, through which there extends the king pin 30, of the pin support 19, which in this case is fixedly connected with the king pin 30 and thus also on the pivot arm 2. Accordingly the step-down transmission 14 is located on the side of the drive motor 13 which is adjacent to the cover 11.

The supply of electrical power to the live stator 28 is in this case within the pivot arm 2 and the king pin 30. The latter is for this purpose provided with a channel 32, in the present case in the form of a slot, in which a cable 33 may be arranged and which may be led through a radial hole in the bushing 31 to the stator 28 mounted on it. The pivot arm 2 is in the illustrated working embodiment constituted by a hollow section, in which a channel 34 for the cable 33 is automatically produced. The cable 33 is run in the channel 34 to a plug and switch unit 35 as illustrated in FIG. 1 and mounted on the pivot arm 2 or on the frame 3, such unit being adapted for the coupling therewith of a connection cable. In the illustrated working embodiment slip ring contact means, not illustrated in the present case, are provided adjacent to the switch and plug unit 35. In this case it is possible for the collar of the plug to be fixed in relation to the frame for the coupling of a cable so that the latter is not damaged even if the pivot arm 2 is turned through 360° a number of times. However it would be possible to attach the switch and plug unit 35 to one of the pivot pins of the pivot arm 3 and to so arrange it that it would be pivoted together with the pivot arm 2. The coupled connection cable would then allow a pivoting movement, even in the form of rotation through 360°, owing to its flexibility. It is convenient in this respect to limit the pivoting movement of the pivot also by means of an abutment. The same applies if instead of the contact slip rings there is an inherently trailing loop of cable.

Although in the above a detailed account has been provided of some preferred working embodiments of the invention, there is no intention to limit the invention thereto and in fact the man in the art would be able to ressort to a series of possible modifications in order to achieve the general purpose of the invention in a specific case. Thus in lieu of the type of transmission illustrated in the figures it is possible to use a harmonic drive or simply an epicyclic transmission with planet wheels even although the type of transmission illustrated in figure is representative of a particularly simple construction and guarantees reliable operation.

In order to ensure particularly quiet running and a particularly long working life of the step-down transmission 14 it is possible however for its inner gear 16 and the outer gear 20 each to have involute teeth and in which in each case a plurality of teeth, for instance three teeth, could be united as unitary tooth and in which in order to avoid excessive strains in the mutual engagement range shortening of the teeth heads by about 5% would be possible.

I claim:

1. A mixer comprising:

a drum having a bottom mounted on a pivotting arm in a cantilever fashion, said pivotting arm having a bushing affixed therein, said bushing having a cover fastened on one side so as to seal said bushing from an exterior environment, said bushing coaxial with an axis of said drum, said bottom having a first wall and a second wall defining a space therebetween, said first wall receiving a first drum bearing, said second wall receiving a second drum bearing;

a motor having a drive shaft extending through one of said first and second drum bearings, said motor having an internal rotor positioned within said bushing, said motor having a stator secured to a flange within said bushing, said flange being affixed to said bushing, said drive shaft interactive with a step-down transmission contained in said space between said first and second walls, said shaft having an eccentric engaging said step-down transmission, said transmission drivingly interconnected between said motor and said drum so as to cause said drum to rotate relative to a speed of said motor, said pivotting arm having a cable channel formed therein, said cable channel for enabling an electrical connection to said motor, said electrical connection extending through a hole in said bushing, said hole communicating with said cable channel, said electrical connection extending to a switchplug of a pivot axis of said pivotting arm.

2. The mixer of claim 1, further comprising:

a fan wheel positioned within said bushing adjacent said cover, said fan wheel attached to said drive shaft of said motor.

* * * * *